US006432604B1

(12) United States Patent
Meyer et al.

(10) Patent No.: US 6,432,604 B1
(45) Date of Patent: Aug. 13, 2002

(54) PROCESS AND APPARATUS FOR OBTAINING INK DISPERSIONS BY SUBJECTING THE LIQUID INKS TO AN ULTRASONIC OR SONIC SIGNAL

(75) Inventors: Robert J. Meyer, Penfield; Christine J. Tarnawskyj, Webster, both of NY (US)

(73) Assignee: Xerox Corporation, Stamford, CT (US)

( * ) Notice: Subject to any disclaimer, the term of this patent is extended or adjusted under 35 U.S.C. 154(b) by 9 days.

(21) Appl. No.: 09/699,703

(22) Filed: Oct. 30, 2000

(51) Int. Cl.[7] ..... G03G 5/00
(52) U.S. Cl. ..... 430/137.1
(58) Field of Search ..... 430/137.1

(56) References Cited

U.S. PATENT DOCUMENTS

| | | | | | |
|---|---|---|---|---|---|
| 4,051,052 | A | * | 9/1977 | Ueda et al. | 252/62.1 |
| 4,171,275 | A | * | 10/1979 | Merrill et al. | 252/62.1 |
| 5,004,165 | A | | 4/1991 | Landa et al. | 241/21 |
| 5,048,762 | A | | 9/1991 | Landa et al. | 241/21 |
| 5,078,504 | A | | 1/1992 | Landa et al. | 366/118 |
| 5,223,368 | A | | 6/1993 | Ciccarelli et al. | 430/110 |
| 5,492,788 | A | | 2/1996 | Denton et al. | 430/137 |
| 5,607,808 | A | * | 3/1997 | Nishizawa et al. | 430/137.1 |
| 5,780,196 | A | * | 7/1998 | Fujiwara et al. | 430/137.1 |

OTHER PUBLICATIONS

M.A. Biot, *Theory of Propagation of Elastic Waves in a Fluid–Saturated Porous Solid*, Mar. 1956, 168.

M.A. Biot, *Theory of Propagation of Elastic Waves in a Fluid–Saturated Porous Solid*, Mar. 1956, 179.

M.A. Biot, *Mechanics of Deformation and Acoustic Propagation in Porous Media*, Apr. 1962, 1482.

D.L. Johnson, T.J. Plona and H. Kojima, *Probing Porous Media with First and Second Sound. II. Acoustic Properties of Water–Saturated Porous Media*, Mar. 1994, 115.

T.J. Plona, R. D'Angelo and D.L. Johnson, *Velocity and Attentuation of Fast, Shear and Slow Waves in Porous Media*, 1991, 1233–1239.

S. Torquato, *Random Heterogeneous Media: Microstructure and Improved Bounds on Effective Properties*, Feb. 1991, 37.

J.E. White, *Seismic Waves: Radiation, Transmission and Attenuation*, 1965, 70.

W.A. Gray, *The Packing of Solid Particles*, 1968, 34.

* cited by examiner

*Primary Examiner*—Mark Chapman
(74) *Attorney, Agent, or Firm*—Lloyd F. Bean, II

(57) ABSTRACT

A method and apparatus for and aggregates in a fluid medium. The present invention employs an ultrasonic device to efficiently breakup particle agglomerates by driving the ultrasonic signal over a small range of frequencies around the acoustic slow wave frequency of the saturated agglomerate. At this frequency, the fluid vibrates out of phase with the solid and is forced out through the pore structure in the agglomerate. This relative fluid motion to exert high viscous stresses at the particle-particle contact points which leads to fracture of the agglomerate and the redispersion of the individual particles. The apparatus includes a dispersing vessel containing aggregates of particles in a fluid, a sonic member for applying an ultrasonic signal in said dispersing vessel for separating the aggregates to form dispersed particles.

9 Claims, 9 Drawing Sheets

PROCESS AND APPARATUS FOR OBTAINING INK DISPERSIONS BY SUBJECTING THE LIQUID INKS TO AN ULTRASONIC OR SONIC SIGNAL

BACKGROUND OF THE INVENTION

Cross reference is made to the following applications filed concurrently herewith: entitled "Method For Improving Oil Recovery Using An Ultrasound Technique", entitled "A Method For Removing Trapped Impurity Aggregates From A Filter", entitled "Method For Dispersing Red And White Blood Cells", entitled "An Ultrasonic Method For Improving Cleaning And Redispersal Of Saturated Particle Aggregates In Processes Using Liquid Inks", entitled "An Ultrasonic Method For Speeding The Drying Of Fluid Saturated Images In Processes Using Liquid Inks ", and entitled "Method For Manufacturing Process".

REFERENCES

M. A. Biot, J. Acoust. Soc. Am. 28, 168 (1956).

M. A. Biot, J. Acoust. Soc. Am. 28, 179 (1956).

M. A. Biot, J. Appl. Phys. 33, 1482 (1962).

D. L. Johnson, T. J. Plona, and H. Kojima, J. Appl. Phys. 76(1), 115 (1994).

T. J. Plona, R. D'Angelo, and D. L. Johnson, "Velocity and attenuation of fast, shear, and slow waves in porous media", in *IEEE* 1990 *Ultrasonics symposium Proceedings, Vol* 3, B. R. McAvoy editor. IEEE, N.Y. (1991), 1233–1239.

S. Torquato, Appl. Mech. Rev. 44 (2), 37 (1991).

J. E. White, *Seimic waves: radiation, transmission, and attenuation*, McGraw-Hill book Company, New York, N.Y., 1965, pg 70.

J. C. Williams, *The packing of solid particles*, Chapman and Hall, Ltd. London England, 1968, pg. 34.

Liquid electrostatic developers having chargeable toner particles dispersed in an insulating nonpolar liquid are well known in the art and are used to develop latent electrostatic images. Ideally, such liquid developers should be replenishable in the particular equipment in which they are used. In general, high solids concentration toners are used for replenishment because relatively low concentrations (e.g., in the range of 10 to 15% by weight solids) result in greater liquid build-up in the equipment, which then must be removed and disposed of as hazardous waste. Thus, it is desirable to initially use a toner containing less liquid, and to maintain the working source located within the equipment, thereby minimizing the undesirable accumulation of carrier liquid in the equipment. When toners are present in the liquid developer in more concentrated form, however, they become difficult to redisperse in the carrier. For example, aggregates may be formed. This can cause serious problems in the replenishment of the liquid developer in the equipment being use. It has been known to use high shear forces between two closely spaced cylindrical surfaces to dissociate liquid toner particles as disclosed in U.S. Pat. Nos. 5,004,165; 5,048,762; 5,078,504; and 5,492,788.

In printing applications these aggregation effects result in grainy images, poor coating uniformity, and poor image to image uniformity and image quality. Breaking up aggregates will result in better image quality. Dispersed particles in inks are subject to many effects that lead to coagulation, limiting shelf life. The liquid-based inks (LID, CEP, and any liquid-based dispersion of small particles) tend to coagulate if left on the shelf for long periods before use. Particles tend to settle under the influence of gravity, producing a sludge layer at the bottom of the container. Brownian motion of the particles due to thermal effects tends to bring particles into contact with one another, leading to coagulation and settling. Charge variations, especially in systems having both sign particles, leads to settling of ink particles. Therefore, it is desirable to have a method and apparatus to readily disperse the particles.

It is also desirable to reuse untransferred cake or inks left on photoreceptors or belts in LID copy or printing engines. However, these materials are often hard to redisperse, and may require the addition of chemical surfactants to obtain new dispersions. However, these additives may change the properties of the inks so that reprocessed inks are not the same in printing characteristics as virgin ink. This limits reuse or recycling of materials. Therefore, it is also desirable to have a method for redispersal to eliminate the need for chemical additives.

High solids suspensions offer greater probabilities for particle-particle collisions, leading to greater rates of coagulation. Thus, high percent solids suspensions offer unique challenges for all of the issues discussed above, eg. shelf life, image quality, and reuse problems. Therefore, it is desirable to have a method to enable the use of concentrated suspensions in more applications.

The methods, as discussed above, have been found acceptable for some applications. However, these dispersion apparatus have the disadvantage in that they require high tolerance, costly mechanical parts to create hydrodynamic sheer to disperse the toner.

A need to provide a less expensive and non-mechanical method for dispersing liquid toner still remains.

SUMMARY OF THE INVENTION

It has been found that the above disadvantages can be overcome and liquid developer replenished in the equipment by means of a system whereby aggregated toner that is present is reduced in size by applying an ultrasonic signal to the liquid developer to disperse the toner particles in carrier liquid.

Accordingly, this invention provides a method and an apparatus for dispersing aggregates in a fluid medium. The present invention employs an ultrasonic device to efficiently breakup particle agglomerates by driving the ultrasonic signal over a small range of frequencies around the acoustic slow wave frequency of the saturated agglomerate. At this frequency, the fluid vibrates out of phase with the solid and is forced through the pore structure in the agglomerate. This relative fluid motion exerts high viscous stresses at the particle-particle contact points, which leads to fracture of the agglomerate and the redispersion of the individual particles in the fluid medium. The apparatus includes a dispersing vessel containing aggregates of particles in a fluid, a sonic member for applying an ultrasonic signal in said dispersing vessel for separating the aggregates to form dispersed particles in the fluid medium.

BRIEF DESCRIPTION OF THE DRAWINGS

The accompanying

DETAILED DESCRIPTION OF THE INVENTION

Figure 1:
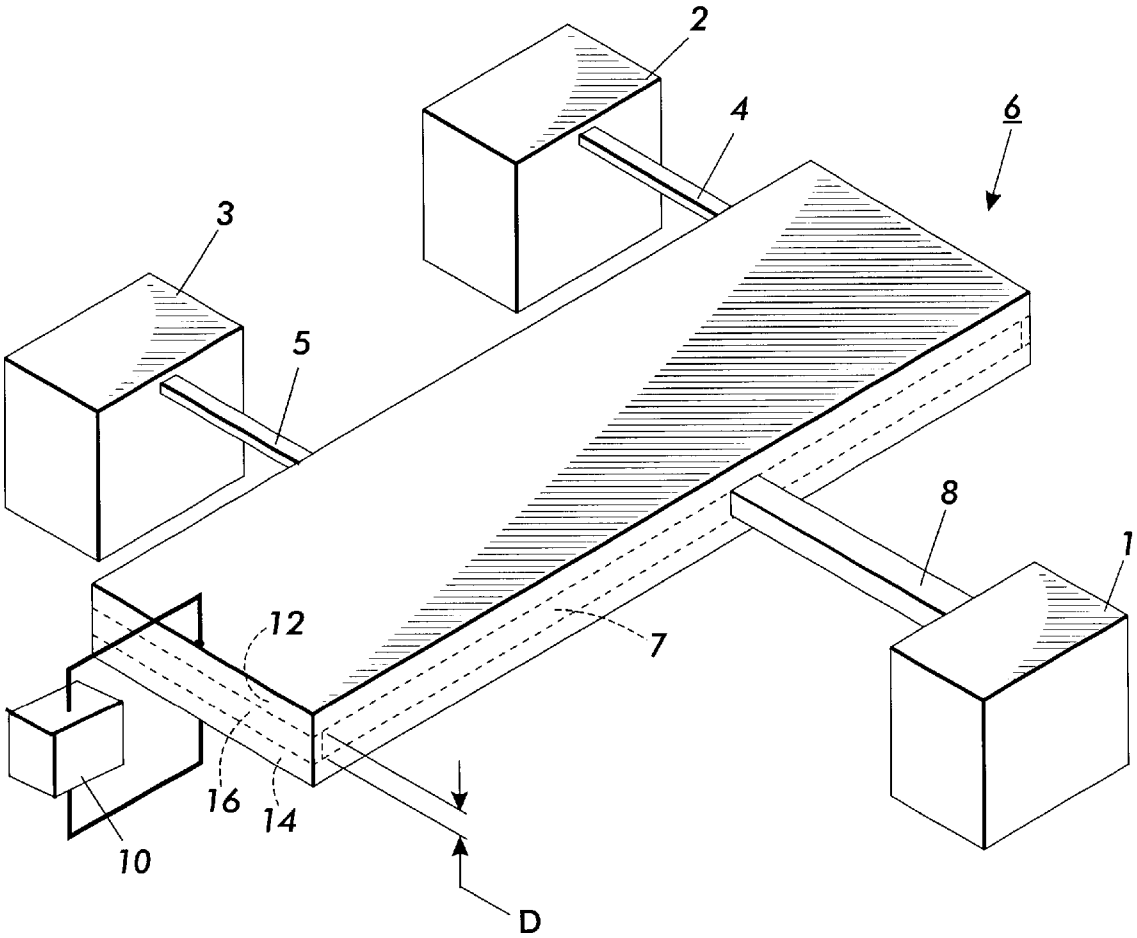
FIG. 1 is a schematic of a system wherein liquid electrostatic developer is replenished by means of supplied dispersed toner in accordance with the invention.

The replenishment system of this invention can be understood by referring to the drawing, wherein all illustrated components are present in a piece of equipment, such as a printer, not shown.

FIG. 1 illustrates an embodiment of the invention wherein supply vessel 1 contains a liquid developer consisting essentially of (A) a nonpolar carrier liquid having a Kauri-butanol value of less than 30, (B) thermoplastic resin particles (toner particles) having a median particle size (volume weighted) less than 15 .mu.m, and with 90% of the particles (volume weighted) less than 30 .mu.m which optionally may contain a dispersed colorant, and (C) a charge director compound, the percent of solids in the developer being abut 0.5 to 6% by weight based on the total weight of liquid developer. "Consisting essentially of" means that the liquid electrostatic developer may contain unspecified components that do not prevent the advantage of the liquid developer from being realized. The replenishment system enables the concentration of solids in the liquid developer to be maintained in the range of about 0.5 to 6% by weight, based on the total weight of liquid developer, using a liquid developer contained in supply vessel 1.

The developer solids concentration is monitored by means known to those skilled in the art such as a calibrated light attenuation sensor. The ingredients for the liquid developer are obtained from at least one liquid toner concentrate vessel 2 that contains aggregates of thermoplastic resin particles having a median particle size (volume weighted) greater than 15 .mu.m, with 90% of the particles (volume weighted) not less than 30 .mu.m. The concentrate is composed of 30 to 100% by weight of such particles and to 70% by weight nonpolar liquid (A). Vessel 3 contains liquid component (A). Means 4 and 5 respectively communicate with concentrate vessel 2 and liquid vessel 3 connecting said vessels with dispersing vessel 6 in order to supply vessel 6 with liquid toner concentrate from vessel 2 and nonpolar liquid from vessel 3. Communicating means 4 and 5 can be pipes, tubes, conduits, or the like, through which the toner concentrate and nonpolar liquid are supplied and metered (by means not shown) into vessel 6. Metering devices can be solenoid metering pumps, piston pumps, metered feed screws, peristaltic pumps, diaphragm pumps, or other metering devices selected on the basis of the physical characteristics of the material being transported. Dispersing vessel 6 contains means for providing an electric field as shown in FIG. 1. Vessel 6 comprises two plates 12 and 14 separated at the perimeter by a resilient member 16. An ultrasonic transducer 100 is connected to voltage supply 10. An ultrasonic transducer 100 can be disposed within plates 12 and 14 or in contact with the outside surface thereof. When a voltage is supplied to ultra sonic transducer 100 vibrational energy is transmitted through dispersing vessel 6, which enable agglomerates of the ink or developer to break apart or fracture thereby providing for the efficient desirable dispersion of the ink solids in the ink carrier fluids.

It has been found by applicants that the agglomerates of toner particles disassociate in an almost explosive manner when subjected to vibrational energy which is near the acoustic slow wave frequency of the aggregates to be dispersed.

Means 8, communicating with dispersing vessel 6, connects the vessel with supply vessel 1 containing the liquid developer to be replenished.

Communicating means 8 can be pipes, tubes, conduits, or the like, through which the dispersed toner particles are supplied and metered (by means not shown) into said vessel as required to maintain the developer solids concentration in vessel 1 as measured by the solids concentration sensor (not shown). The metering device can be solenoid metering pumps, metered feed screws, peristaltic pumps, piston pumps, diaphragm pumps, or other metering characteristics of the material being transported. At least one of supply vessel 1, liquid toner concentrate vessel 2 or liquid vessel 3.

The specific ingredients used to make up the composition of the liquid electrostatic developer are described in U.S. Pat. No. 5,492,788 which is incorporated by reference. The liquid developers suitable for the present invention generally comprise a liquid vehicle, toner particles, and a charge control additive. The liquid medium may be any of several hydrocarbon liquids conventionally employed for liquid development processes, including hydrocarbons, such as high purity alkanes having from about 6 to about 14 carbon atoms, carrier fluids such as Norpar 15® and Isopar L® or Superla® and Isopar L® or a mixture of two or more of the above fluids. The amount of the liquid employed in the developer of the present invention is from about 90 to about 99.9 percent, and preferably from about 95 to about 99 percent by weight of the total developer dispersion. The total solids content of the developers is, for example, 0.1 to 10 percent by weight, preferably 0.3 to 3 percent, and more preferably, 0.5 to 2.0 percent by weight. Examples of charge directors include components such as (1) a protonated AB diblock copolymer of poly[2-dimethylammoniumethyl methacrylate bromide co-2-ethylhexyl methacrylate], poly [2-dimethylammoniumethyl methacrylate tosylate co-2-ethylhexyl methacrylate], poly[2-dimethylammoniumethyl methacrylate chloride co-2-ethylhexyl methacrylate], poly [2-dimethylammoniumethyl methacrylate bromide co-2-ethylhexyl acrylate], poly[2-dimethylammoniumethyl acrylate bromide co-2-ethylhexyl methacrylate], poly[2-dimethylammoniumethyl acrylate bromide co-2-ethylhexyl acrylate], poly[2-dimethylammoniumethyl methacrylate tosylate co-2-ethylhexyl acrylate], poly[2-dimethylammoniumethyl acrylate tosylate co-2-ethylhexyl acrylate], poly[2-dimethylammoniumethyl methacrylate chloride co-2-ethylhexyl acrylate], poly[2-dimethylammoniumethyl acrylate chloride co-2-ethylhexyl acrylate], poly[2-dimethylammoniumethyl methacrylate bromide co-N,N-dibutyl methacrylamide], poly[2-dimethylammoniumethyl methacrylate tosylate co-N,N-dibutyl methacrylamide], poly[2-dimethylammoniumethyl methacrylate bromide co-N,N-dibutylacrylamide], or poly [2-dimethylammoniumethyl methacrylate tosylate co-N,N-dibutylacrylamide]; (2) a mixture, for example 50:50, of at least two protonated AB diblock copolymers; (3) a mixture, for example 50:50, of at least one protonated AB diblock copolymer and one quarternized AB diblock copolymer, and the like. The charge directors as illustrated in the patents and copending applications mentioned herein can be selected for the developers of the present invention. The charge director can be selected for the liquid developers in various effective amounts, such as, for example, in embodiments from about 0.5 percent to 80 percent by weight relative to developer solids and preferably 2 percent to 20 percent by weight relative to developer solids. Developer solids include toner resin, pigment, and charge adjuvant. Without pigment the developer may be selected for the generation of a resist, a printing plate, and the like. Examples of other effective charge director for liquid toner particles include anionic glyceride, such as EMPHOS® D70-30C and EMPHOS® F27-85, two products sold by Witco Corporation, New York, N.Y., which are sodium salts of phosphated mono- and diglycerides with saturated and unsaturated substituents respectively, lecithin, Basic Barium Petronate, Neutral Barium Petronate, Basic Calcium Petronate, Neutral Calcium Petronate, oil soluble petroleum sulfonates, Witco Corporation, New York, N.Y., and metallic soap charge directors such as aluminum tristearate, aluminum distearate, barium, calcium, lead, and zinc stearates; cobalt, manganese, lead, and zinc lineolates, aluminum, calcium, and cobalt octoates; calcium and cobalt oleates; zinc palmitate; calcium, cobalt, manganese, lead, zinc resinates, and the like. Other effective charge directors include AB diblock copolymers of 2-ethylhexylmethacrylate-co-methacrylic acid calcium and ammonium salts. Any suitable thermoplastic toner resin can be selected for the liquid developers of the present invention in effective amounts of, for example, in the range of about 99 percent to 40 percent of developer solids, and preferably 95 percent to 70 percent of developer solids, which developer solids includes the thermoplastic resin, optional pigment and charge control agent, and any other component that comprises the particles. Examples of such resins include ethylene vinyl acetate (EVA) copolymers (ELVAX® resins, E.I. DuPont de Nemours and Company, Wilmington, Del.); copolymers of ethylene and an alpha.-.beta.-ethylenically unsaturated acid selected from the group consisting of acrylic acid and methacrylic acid; copolymers of ethylene (80 to 99.9 percent), acrylic or methacrylic acid (20 to 0.1 percent)/alkyl (C.sub.1 to C.sub.5) ester of methacrylic or acrylic acid (0.1 to 20 percent); polyethylene; polystyrene; isotactic polypropylene (crystalline); ethylene ethyl acrylate series sold under the trademark BAKELITE® DPD 6169, DPDA 6182 Natural (Union Carbide Corporation); ethylene vinyl acetate resins, for example DQDA 6832 Natural 7 (Union Carbide Corporation); SURLYN® ionomer resin (E.I. DuPont de Nemours and Company); or blends thereof; polyesters; polyvinyl toluene; polyamides; styrene/butadiene copolymers; epoxy resins; acrylic resins, such as a copolymer of acrylic or methacrylic acid and at least one alkyl ester of acrylic or methacrylic acid wherein alkyl is from 1 to about 20 carbon atoms like methyl methacrylate (50 to 90 percent)/methacrylic acid (0 to 20 percent/ethylhexyl acrylate (10 to 50 percent); and other acrylic resins including ELVACITE® acrylic resins (E.I. DuPont de Nemours and Company); or blends thereof. Preferred copolymers are the copolymer of ethylene and an .alpha.-.beta.-ethylenically unsaturated acid of either acrylic acid or methacrylic acid. In a preferred embodiment, NUCREL® , like NUCREL 599®, NUCREL 699®, or NUCREL 960® are selected as the thermoplastic resin. The liquid developer of the present invention may optionally contain a colorant dispersed in the resin particles. Colorants, such as pigments or dyes and mixtures thereof, are preferably present to render the latent image visible. The colorant may be present in the resin particles in an effective amount of, for example, from about 0.1 to about 60 percent, and preferably from about 1 to about 30 percent by weight based on the total weight of solids contained in the developer. The amount of colorant selected may vary depending on the use of the developer. Examples of colorants include pigments like carbon blacks like REGAL 330®, cyan, magenta, yellow, blue, green, brown and mixtures thereof; pigments as illustrated in U.S. Pat. No. 5,223,368, the disclosure of which is totally incorporated herein by reference.

The present invention improves the efficiency of ultrasonic aggregate dispersion techniques by tailoring the ultrasonic frequency specifically to the nature of the aggregates that are to be dispersed. As discussed in more detail below, aggregate breakup is possible by utilizing ultrasonic waves at or near a specific frequency called the acoustic slow wave frequency. At this point fluid is forced to move through the pore spaces and necks within each individual particle aggregate. This fluid motion exerts viscous drag forces on the particles, especially in the region of particle-particle contact points, and acts to break the adhesive particle-particle bonds within the solid frame of the aggregate. Thus, these forces act over an entirely different distance range, and via a different mechanism, than the forces acting between pressure maxima and minima in an ultrasonic wave. The acoustic slow wave method of the present invention makes use of the realization that the propagation of sound through porous media containing a viscous fluid has different modes of motion which may be excited at different frequencies.

Typical aggregate sizes may vary from 10 to several hundred primary particles, or from 1 micron to 200 microns in average volume diameter prior to sonification. The sonification comprises applying the ultrasonic signal for a period of time of from about 0.01 seconds ( e.g., 100 cycles at a 10 KHz slow wave frequency) to several minutes.

In an embodiment of the invention, the acoustic slow wave mode is used to break up particle aggregates in which the physical properties of the particle aggregates and their pore fluid is known. The frequency of the ultrasound is set by of knowing the following information: the particle size, some notion of their packing fraction (or percent solids in the aggregates), and the viscosity and density of the pore fluids. From this information, as discussed below, we can estimate the acoustic slow wave frequency, i.e., the frequency that we want to apply to the suspension of fluid and fluid-saturated aggregates as (White, 1965):

$$f_o=\eta\phi/(2\pi k\ \rho f) \quad (1)$$

where $\eta$ is the fluid viscosity, $\phi$ is the aggregate porosity, k is the aggregate permeability, and $\rho_f$ is the fluid density.

By applying this frequency ultrasonic signal, or white ultrasonic energy around the acoustic slow wave frequency we can redisperse a coagulated suspension of particles, or prevent coagulation of an initially dispersed suspension.

Figure 4:
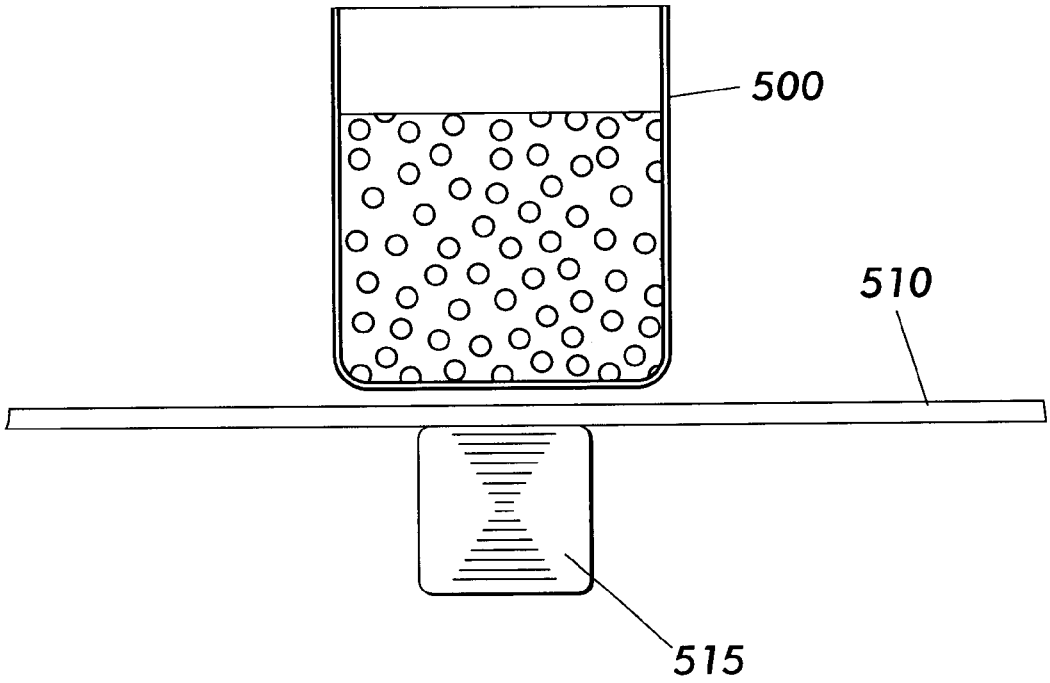
FIG. 4 is an embodiment of the present invention.

The ultrasonic applying means for applying an acoustic slow wave in the present invention can be, for example, Ultrasonic probes vibrating at or around (see the discussion below of "white" sources") can be inserted into containers containing aggregates to be dispersed; Fluid can be pumped through a pipe which has an internal or external ultrasonic piezoelectric probe vibrating at or around the acoustic slow wave frequency. Alternatively, container 500 can be placed on an ultrasonic stage 510 using a piezoelectric vibrator 515, as shown in FIG. 4, that allows vibrations to pass through the container into the fluid/aggregate system at or around the acoustic slow wave frequency.

Figure 5:
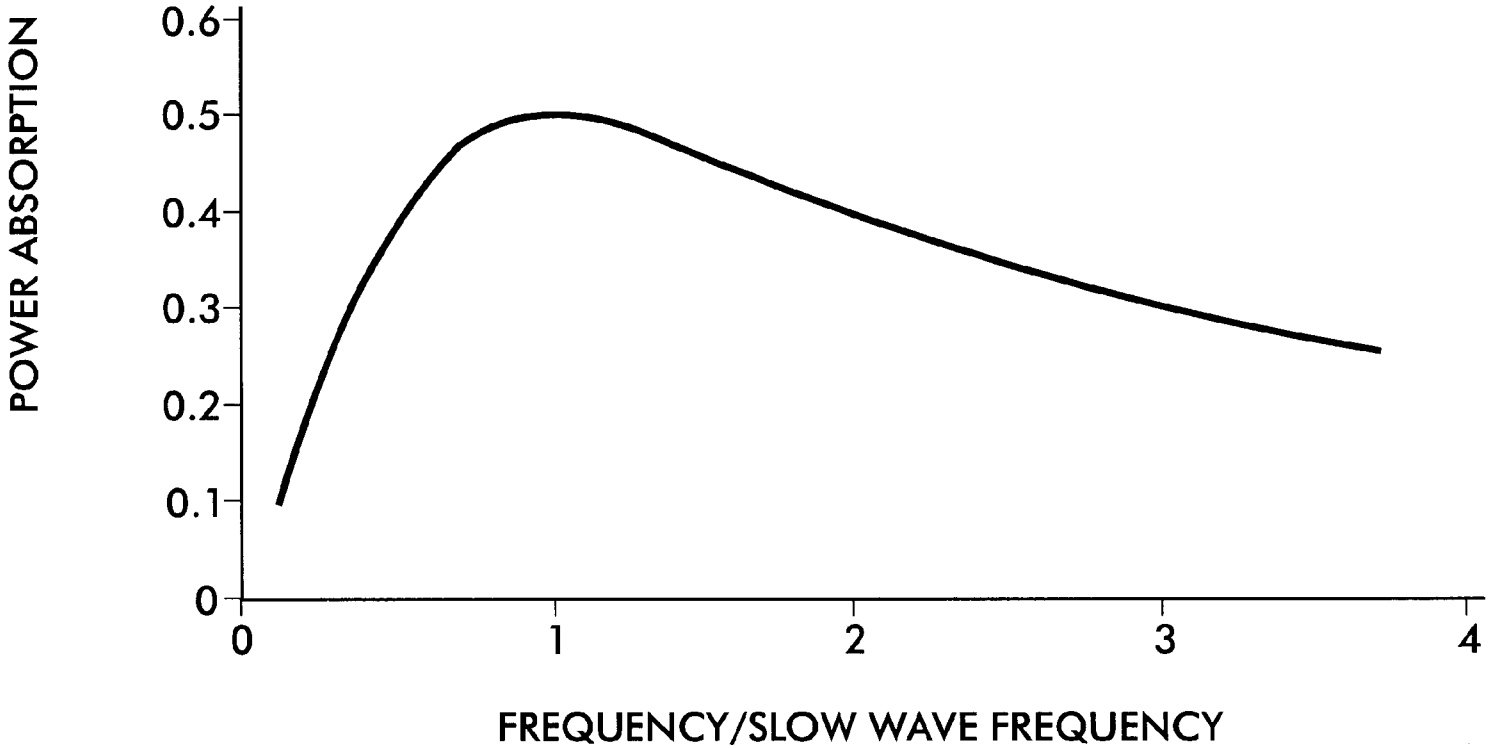
FIGS. 5 and 6 are illustrative graphs showing power absorption spectrum.

In addition to setting the frequency of oscillation to the acoustic slow wave frequency, or making a frequency spectrum containing the acoustic slow wave frequency, it is also possible to use feedback control techniques to experimentally determine the acoustic slow wave frequency, and to track changes in the frequency as it changes due to aggregate breakup. If a range of ultrasound frequencies are pumped into a specimen, and the power absorption is analyzed as a function of frequency, at the acoustic slow wave frequency the power absorbed by the system will be the maximum, as shown in FIG. 5. It has been found that compressional attenuation is 90–99% due to excitation of the compressional slow wave over frequency ranges where it can occur. Normal sound wave attenuation provides only a low background power absorption over a broad frequency range compared to the high frequency-specific attenuation due to excitation of the slow wave.

The peak in the power absorption profile can be tracked by power spectrum analysis techniques, and the excitation spectrum changed to follow the time-varying demands of the system (eg., as new aggregates are added, as flow rates vary, etc.).

The present invention can also be utilized as a measurement tool. For example, the power absorbed by an aggregate slurry will give a measurement of the concentration of aggregates. If the amplitude of vibration is kept low enough so that adhesive forces are not overcome and the aggregates broken, this can be used as a measurement tool to determine the concentration of aggregates in a suspension.

Figure 6:
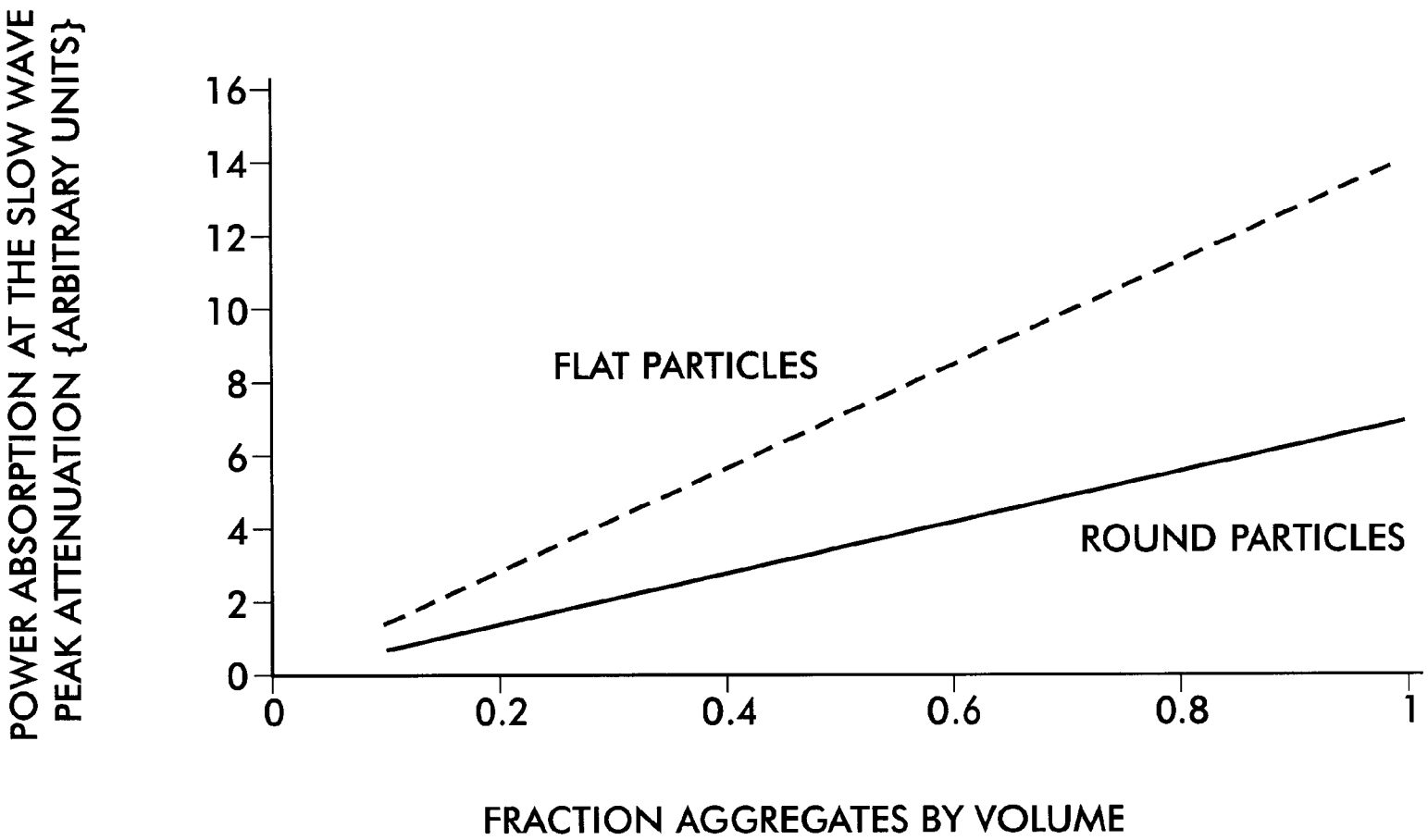

As shown in FIG. 6, the power absorption at the peak of the power absorption frequency spectrum (i.e., the slow wave frequency) is proportional to the concentration of aggregates in the sample. As discussed above, this power absorption is almost entirely due to slow wave excitation in aggregates. Power absorption by normal sound excitation is smaller by 1–2 orders of magnitude. Also noted in FIG. 6 is the dependence of the power absorption-concentration curve on the shape of the pores in the aggregate. For pores between spherical particles the slope of the curve is lower than for pores between long flat particles. Thus, there is some degree of experimental calibration through the use of microscopically characterized samples that must be done if there is a distribution of particle shapes and sizes. Such calibration techniques are well known to those skilled in the art.

Figure 2:
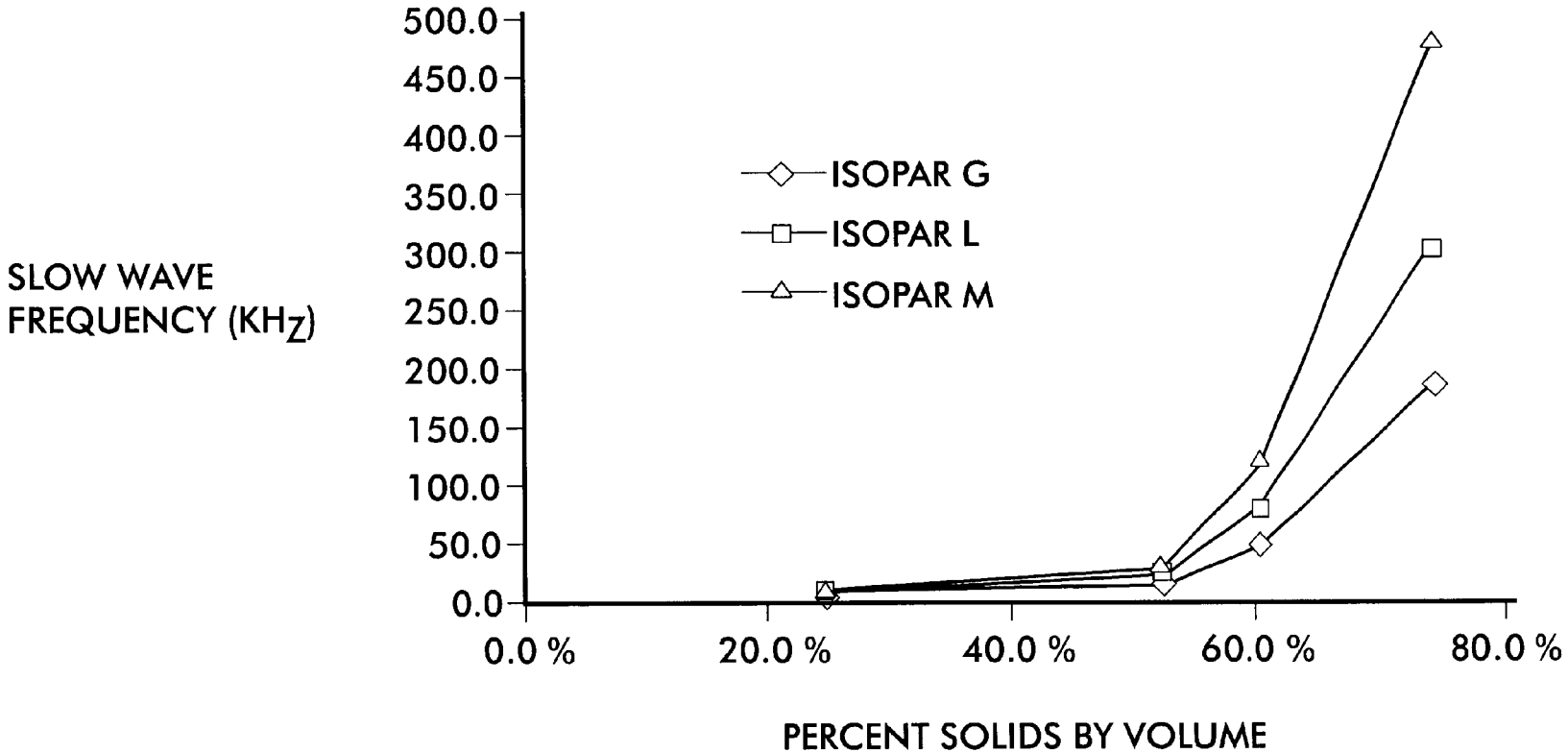
FIG. 2 is a graph of acoustic slow wave frequencies for various liquid developers used in present invention.

Typical acoustic slow wave frequencies are shown in FIG. 2 for aggregates composed of 2-micron particles in Isopar G, L, and M. As indicated in FIG. 2, as the percent solids in an aggregate decreases with breakup, the acoustic slow wave frequency that will have the maximum disruptive effect on the aggregate decreases.

In order to maintain the effectiveness of the ultrasonic vibration throughout it's excitation of an aggregate, the frequency of the driving source must either (1) change with time, or preferably, (2) contain all of the appropriate frequencies at all times. Both frequency signatures are possible and potentially useful, and hence offer different embodiments of the invention. Thus, as indicated by FIG. 2, to track the complete breakup of an aggregate that starts at about 60% solids concentration, the source should be "white" over a frequency range of approximately 10–60 kHz (for an isopar L pore fluid and 2 micron toner particles).

Figure 3:
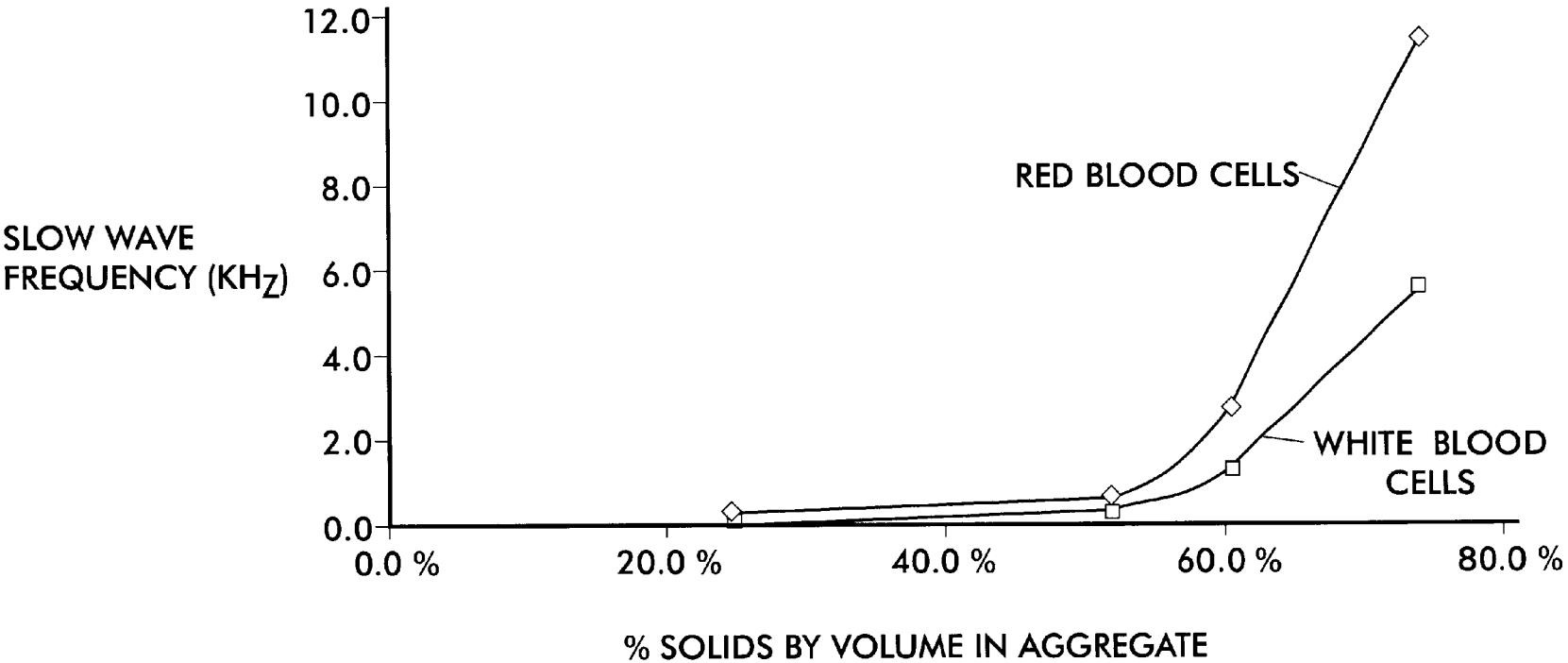
FIG. 3 is a graph of acoustic slow wave frequencies for red blood cells and for white blood cells. Blood cell agglomerates can be redispersed by the present invention.

It is evident that the present invention may be used in other fields. For example, an application is in the prevention of aggregation of blood cells in blood bank supplies to extend shelf life. FIG. 3 illustrates the acoustic slow wave frequencies required to disperse red blood cells and white blood cells that have settled under the influence of gravity in stored whole blood supplies. Bags of whole blood can be put on a sonic stage as in FIG. 4 and an acoustic slow wave frequencies can be applied, thereby keeping blood cells dispersed. While ultrasonic signals may damage blood cells via cavitation, from bubbles forming under the pressure variations of the ultrasound, the sonic frequency range of the appropriate compressional slow wave is unlikely to cause such damage. Cavitation is reduced at these low frequencies.

Another application of the present invention is to break up color pigment aggregates in the EA toner formation process, in order to obtain better color saturation. It is known that the color saturation, or chroma level, that can be achieved by color toners consisting of color pigments dispersed in a transparent binder is influenced to a large degree by the completeness of the dispersion of the pigments. Aggregated pigments tend to produce toners with washed-out or less bright colors than those achieved with well-dispersed pigments. On the other hand, it is difficult to achieve good dispersion with color pigments. This is due to the strong van der Waals forces that exist between these pigments, leading to strong, hard to disperse, aggregates.

The acoustic slow wave is in general not applicable to breaking up pigment aggregates in xerographic toners because the pigments are to ground into the toner binders in the dry state. There is no pore fluid motion to break up the pigment aggregates.

Figure 7:
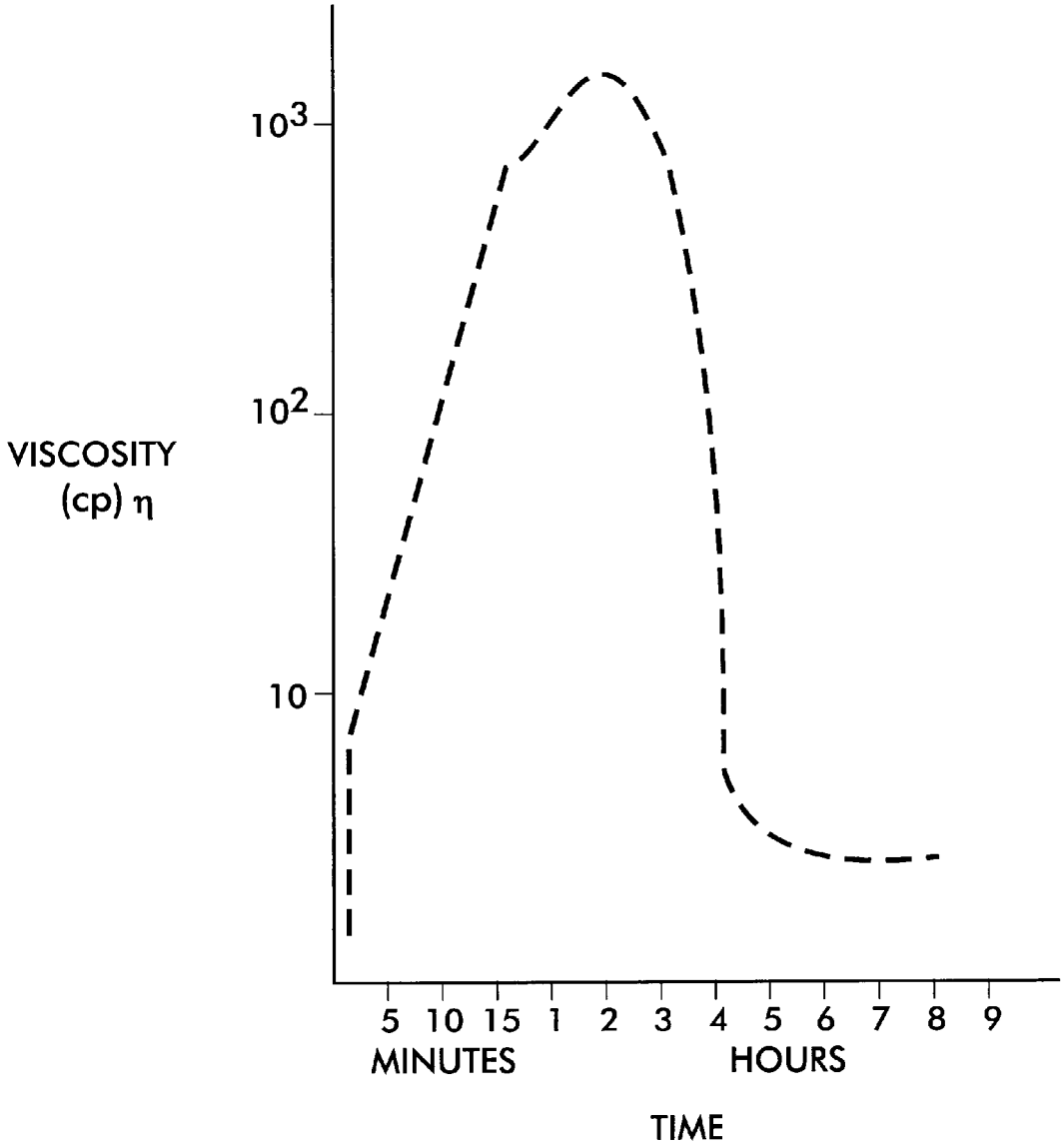
FIG. 7 is a graph showing viscosity as a function of time in Emusion Aggregation (EA) toner fabrication process.

However, in the EA toner formation process, the pigments are added to the fluid suspension of latex spheres in liquid. Thus there is fluid that can be excited into the acoustic slow wave mode of relative fluid-solid motion via ultrasonic waves. In liquids, ultrasonic waves up to about 1 MHz can be generated. EA toner formation process includes dispersing pigment and wax in solution of particle latex constituents; emulsifying the solution to form latex particles; blending the mixture of latex particles, wax, and pigment to gain uniformity; aggregating and coalescing the latex particles, wax, and pigment to form toner particles; washing the toner particles to remove surfactants which give a high surface energy to the toner particles; and drying the final toner particles, during dispersing, emulsifying, blending step subjecting the fluid mixture to a slow wave frequency. It is preferred to varying the slow wave frequency base on the viscosity. By the aggregating step the fluid viscosity is sufficiently high that the slow wave frequency is unattainable There is a stage in the formation process when the suspension viscosity is relatively low. This is shown in FIG. 7. Using this viscosity versus time data, we can estimate the change in EA toner color pigment acoustic slow wave frequency versus time. The results are shown in FIG. 8.

Figure 8:
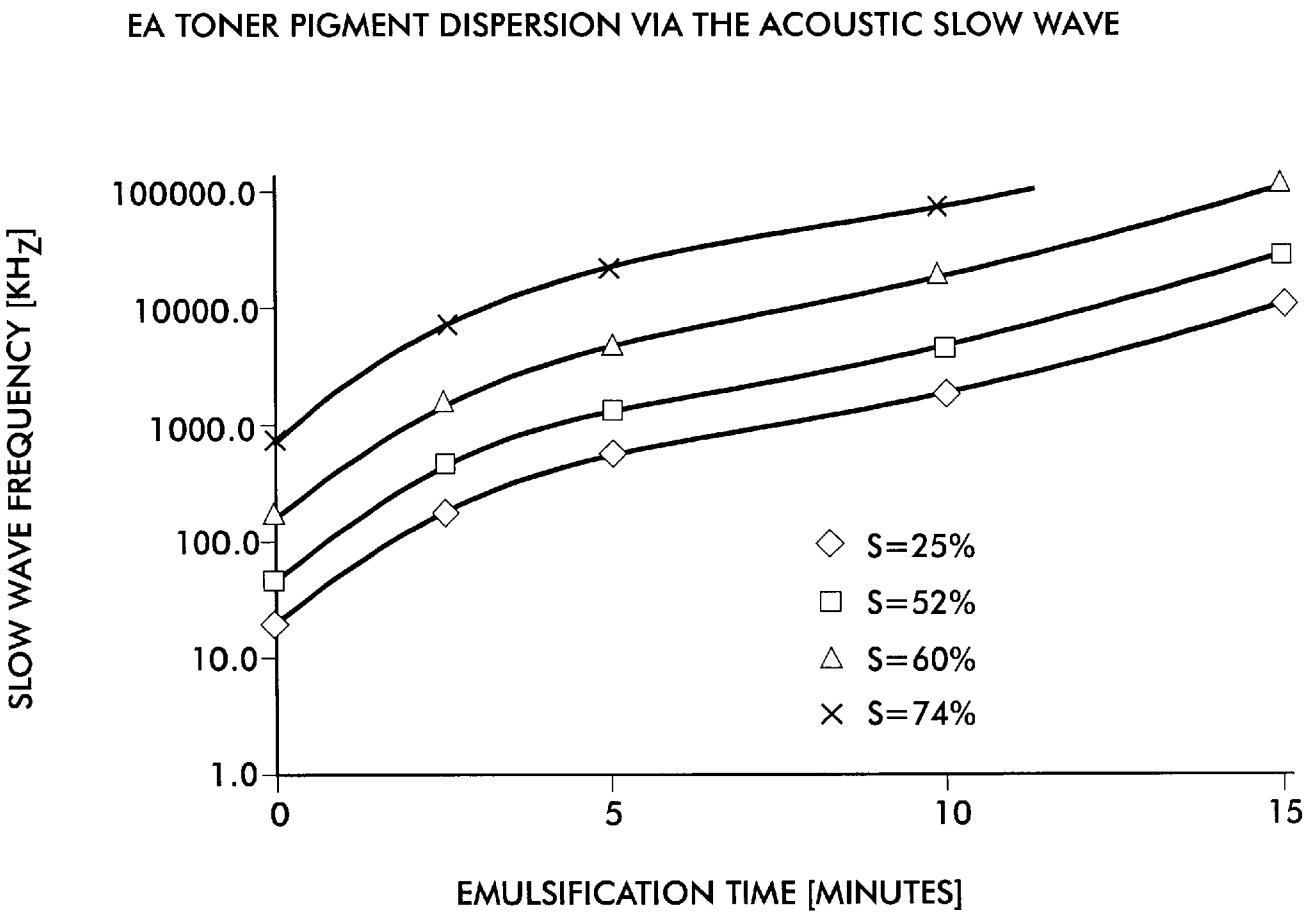
FIG. 8 is a graph showing slow wave frequency as a function of time in EA toner fabrication process.

As we see from FIG. 8, depending on the percent solids in a pigment aggregate, the acoustic slow wave is predicted to be able to break up pigment aggregates for up to the first 7–8 minutes of the emulsification process.

These same results can be viewed in a different way. As we see from FIG. 9, at any particular point in time, as the aggregate breaks up, the slow wave frequency drops.

Figure 9:
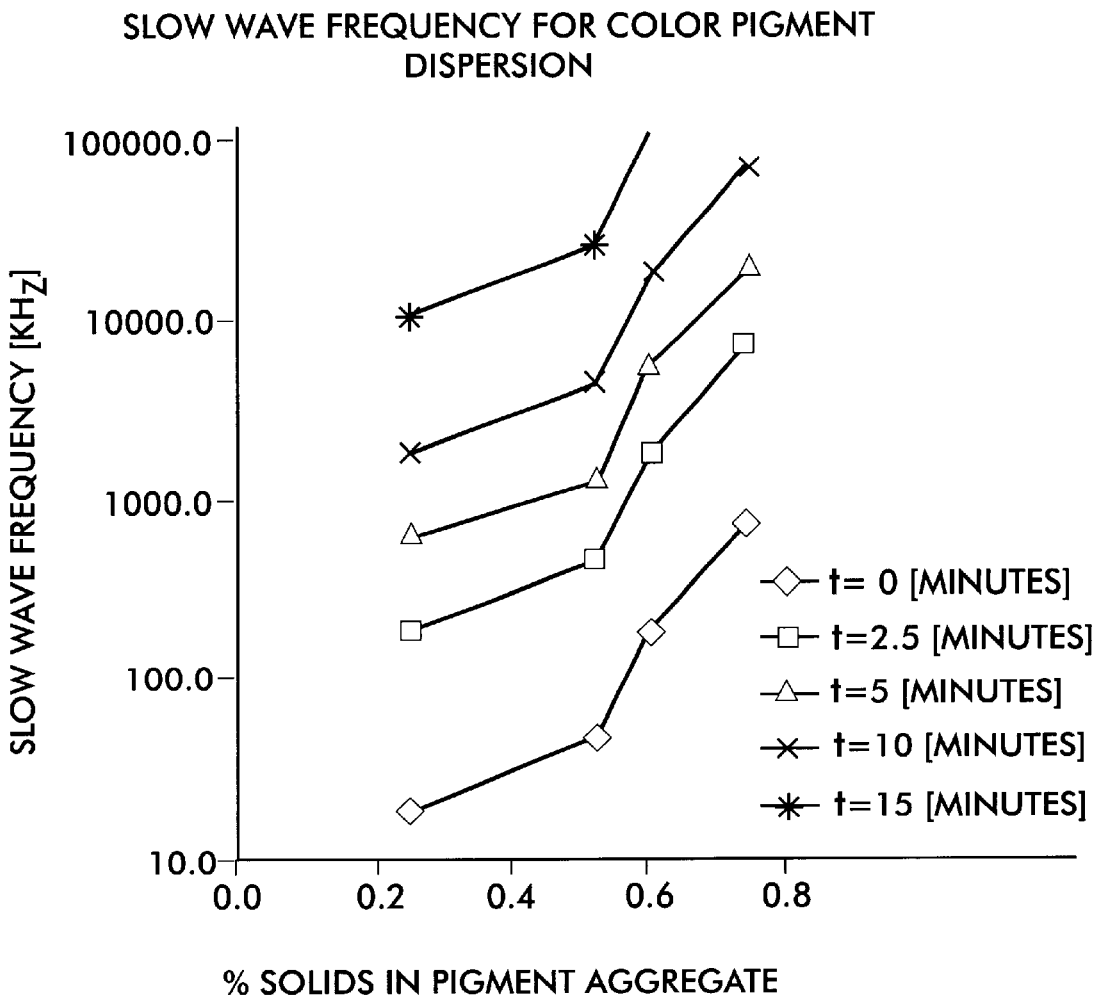
FIG. 9 is a graph showing slow wave frequency as a function of percent solids in EA toner fabrication process.

From FIG. 8 and FIG. 9 we conclude that a fixed ultrasonic excitation frequency, such as 500 kHz, would break up all aggregates below about 60% solids (by volume) as the viscosity naturally increases during the excitation process. This includes for all practical purposes, all aggregates likely to occur. The ordered structures (face centered cubic packing) necessary to exceed this packing fraction are statistically very unlikely. This aggregate breakup process should continue down to virtually the single particle limit, unlike usual ultrasonic aggregate breakup techniques which fail at mm size aggregates.

The acoustic slow wave technique for obtaining good pigment particle dispersion should: enable the development of toners which have as high chroma as possible at any particular pigment loading, consistent with the optical properties of the pigment; allow higher pigment concentrations (into a pigment loading regime that would normally be inaccessible due to pigment aggregation problems); and allow the use of pigments which would not previously be usable due to their high stickiness.

There are similar applications of acoustic slow waves to keep pigments dispersed in other xerographic subsystems than EA toner. Pigments in the organic photoreceptor layers. Acoustic slow waves should work better for pigment dispersion in all of these cases.

Having in mind the main elements of the present invention, and not wanting to be limited to theory, the present invention is believed to operate as follows: When a solid containing a fluid is subject to a sound wave, the fluid and the liquid will oscillate in the direction of propagation of the sound wave. In general, the fluid and the porous solid respond at slightly different rates. In the limit of very low frequency the porous solid and the liquid will respond completely in phase, resulting in no net motion of the fluid with respect to the porous solid. In this limit, as discussed in the paragraph above, forces within the fluid-saturated solid occur between the maximum and minimum pressure positions within the solid, located ½ wavelength apart. Since a single particle agglomerate is small compared to the size of the wavelength of the sound wave, the pressure differences within a single agglomerate are small, resulting in small forces acting to break up the particle.

As the frequency of the driving sound wave increases, the viscous fluid motion lags slightly behind that of the approximately rigid solid. This results in fluid motion through pores in the particulate solid, which in turn is induces stresses on the particle-particle contact points.

As the frequency increases, the phase lag in relative motion between the solid and liquid also increases, at least up to a point. At a point called the acoustic slow wave point the motion of the solid and liquid will be 180 degrees out of phase. At this point we have the maximum amount of motion of the fluid with respect to the aggregated solid. This results in the maximum viscous stress on the adhesive bonds. If these viscous shearing forces exceed the shear strength of the adhesive bonds between particles, the aggregate will start to fall apart. Now, however, these forces tending to destroy the aggregate will occur on the interparticle length scale, not on a scale of ½ the wavelength of the sound wave in the composite fluid.

The first analysis of these different modes of fluid motion was carried out by Biot (1956a,b; 1962), and has been a topic of continuing research [see Johnson, Plona, and Kojima (1994) and references cited therein]. The acoustic slow wave mode is also sometimes called the "compressional slow wave" or just the "slow wave". These waves have been observed experimentally in a variety of porous solids, and are well-verified (Johnson, et. al., 1994).

The frequency of the acoustic slow wave mode, $f_c$, in an infinite porous solid is given by (White, 1965):

$$f_c=\eta\phi/(2\pi k\rho_f) \quad (1)$$

where $\eta$ is the fluid viscosity, $\phi$ is the aggregate porosity, k is the aggregate permeability, and pf is the fluid density. $\phi$ depends on the volume fraction of solids in the aggregate particle via:

$$\phi=1-(\%\ S/100) \quad (2)$$

where %S is the percent of solids in the aggregate, by volume. This expression can be easily converted to reflect porosity in terms of %S by weight.

It is obviously impossible (or at least very difficult) to directly measure the permeability of a single particle aggregate. Therefore it is preferable to predict the aggregate permeability. There are several ways in which this can be done. Variational bounds giving the upper and lower limits have been put on the permeability of particle composites [see e.g., Torquato (1991), and references cited therein]. There are also phenomenological relationships between the permeability and related quantities such as aggregate porosity. For this analysis we make use of the Carmen-Kozeny equation, which has the advantage of being a physically plausible form suggested by physical arguments, with a phenomenologically determined prefactor:

$$k=B\phi^3/\{S_v^2(1-\phi)^2\} \quad (3)$$

where B is a constant, typically on the order of 5, and $S_v$ is the particle surface area per unit volume within the aggregate. $S_v$ will depend on the particle size and packing of the particles, and is inversely proportional to particle diameter (Williams, 1968). Several specific particle packings have been used to calculate both $S_v$ (for use in Equations(1)–(3)) and %S in FIGS. (2) and (3), using information on the packings provided in Williams (1968). For example, for cubic close packing of particles, the porosity $\phi$=0.476, and $S_v=\pi/D$, where D is the particle diameter. For body centered cubic packing the porosity $\phi$=0.395, and $S_v=2\pi/D$. For face centered cubic packing the porosity $\phi$=0.26, and $S_v=4\pi/D$. For random packing the porosity $\phi$=0.63, and $S_v=\pi/D$. This information on $S_v$ plus Equations (1) and (3) allow the compressional slow wave frequency to be estimated by:

$$f_c=\eta\{S_v^2(1-\phi)^2\}/(2\pi B\ \phi^2\rho_f). \quad (4)$$

Useful compressional slow wave frequency can be in the range between ±15% of the calculated or measured peak slow wave frequency In recapitulation, there has been provided a method and apparatus for dispersal of aggregates in a fluid medium. The present invention employs a sonic or ultrasonic device to efficiently breakup particle agglomerates by driving the ultrasonic signal over a small range of frequencies around the acoustic slow wave frequency of the saturated agglomerate. At this frequency, the fluid vibrates out of phase with the solid and is forced out through the pore structure in the agglomerate. This relative fluid motion exerts high viscous stresses at the particle-particle contact points which leads to fracture of the agglomerate and the redispersion of the individual particles. The apparatus includes a dispersing vessel containing aggregates of particles in a fluid, a sonic member for applying an ultrasonic signal in said dispersing vessel for separating the aggregates to form dispersed particles.

It is, therefore, evident that there has been provided, in accordance with the present invention, a system for replenishing liquid electrostatic developer that fully satisfies the aims and advantages hereinbefore set forth. While this invention has been described in conjunction with one embodiment thereof, it is evident that many alternatives, modifications and variations will be apparent to those skilled in the art. Accordingly, it is intended to embrace all such alternatives, modifications and variations as they fall within the spirit and broad scope of the appended claims.

What is claimed is:

1. A process which comprises subjecting a liquid developer including agglomerates of a thermoplastic resin, a pigment, and a charge adjuvant dispersed in a liquid to ultrasonic signal, said subjecting step comprises applying a predefined acoustic slow wave frequency based upon the agglomerates-particle sizes in said liquid developer to cause liquid to vibrate out of phase with solid portions of agglomerates and is forced out through the pore structure in the agglomerates to break the agglomerates apart.

2. A process in accordance with claim 1, wherein said subjecting step comprises breaking apart of the solids of resins, pigment, and charge adjuvant to subsequent to the use of said ultrasonic signal.

3. A process in accordance with claim 1, wherein said subjecting step reduces the solids of resins, pigment and charge adjuvant in size subsequent to the said ultrasonic signal being applied thereon.

4. A process in accordance with claim 3, wherein said subjecting step comprises applying the ultrasonic signal for a period of time of from about 0.1 seconds to about several minutes.

5. A process in accordance with claim 3, further comprising selecting aggregate particles containing from 10 to about several hundred primary particles, or from 1 micron to 200 microns in average volume diameter prior to said subjecting step.

6. A process in accordance with claim 3, wherein the particles in size subsequent to the ultrasonic signal being applied thereon from about 0.01 micron to about 20 microns average volume diameter, comprising the primary unaggregated particle size.

7. A process in accordance with claim 1, wherein said applying step includes employing a multiple of said acoustic slow wave frequency.

8. A process in accordance with claim 1, wherein is said acoustic slow wave frequency determine by the following equation:

$$f_{c-\eta\{S_v^2(1-\phi)^2\}/(2\pi B\phi^2\rho_f)}$$

Where $f_c$ is the acoustic slow wave frequency, $\eta$ is the fluid viscosity, $S_v$ is the primary particle surface area per unit volume of the aggregate, $\phi$ is the aggregate porosity, $\rho_f$ is the fluid density, and B is a phenomenological constant.

9. The process of claim 8, wherein the ultrasonic frequency is about −15% to +15% of $f_c$.

* * * * *